US009540801B2

(12) United States Patent
Hill

(10) Patent No.: US 9,540,801 B2
(45) Date of Patent: Jan. 10, 2017

(54) MULTI-PIECE TRUSS PLATE FOR USE IN JOINING TWO STRUCTURAL MEMBERS

(71) Applicant: Oz-Post International, LLC, Richardson, TX (US)

(72) Inventor: Ian A. Hill, Plano, TX (US)

(73) Assignee: OZ-POST INTERNATIONAL, LLC, Richardson, TX (US)

( * ) Notice: Subject to any disclaimer, the term of this patent is extended or adjusted under 35 U.S.C. 154(b) by 0 days.

(21) Appl. No.: 13/926,370

(22) Filed: Jun. 25, 2013

(65) Prior Publication Data

US 2014/0007541 A1 Jan. 9, 2014

Related U.S. Application Data

(60) Provisional application No. 61/669,180, filed on Jul. 9, 2012.

(51) Int. Cl.

| | |
|---|---|
| ***E04B 1/38*** | (2006.01) |
| ***E04B 1/41*** | (2006.01) |
| ***E04C 3/02*** | (2006.01) |
| ***E04B 1/26*** | (2006.01) |
| *E04B 1/24* | (2006.01) |
| *E04C 3/17* | (2006.01) |

(52) U.S. Cl.

CPC ..... *E04B 1/40* (2013.01); *E04B 1/2604* (2013.01); *E04C 3/02* (2013.01); *E04B 2001/2415* (2013.01); *E04B 2001/2457* (2013.01); *E04B 2001/2644* (2013.01); *E04C 3/17* (2013.01)

(58) Field of Classification Search

CPC .. E04B 1/40; E04B 1/2604; E04B 2001/2644; E04B 1/38; E04B 1/2612; E04B 2001/2415; E04B 2001/2457; E04B 2001/405; E04C 3/02; E04C 3/17

USPC .... 52/712, 713, 654.1, 655.1, 696; 403/286, 403/300, 305, 306

See application file for complete search history.

(56) References Cited

U.S. PATENT DOCUMENTS

| | | | | | |
|---|---|---|---|---|---|
| 721,411 | A | * | 2/1903 | Alexander | 403/279 |
| 3,226,118 | A | * | 12/1965 | Nehl | 473/414 |
| 3,449,997 | A | * | 6/1969 | Couch | 411/466 |
| 3,640,557 | A | * | 2/1972 | Nute et al. | 403/2 |
| 4,080,768 | A | * | 3/1978 | Trixl | 52/521 |
| 4,507,009 | A | * | 3/1985 | Tardif | 403/306 |
| 4,733,986 | A | * | 3/1988 | Kenning et al. | 403/306 |
| 5,577,353 | A | * | 11/1996 | Simpson | 52/92.2 |

(Continued)

*Primary Examiner* — Adriana Figueroa
*Assistant Examiner* — Jessie Fonseca
(74) *Attorney, Agent, or Firm* — Gardere Wynne Sewell, LLP; Andre M. Szuwalski; John J. "Jake" May

(57) ABSTRACT

A first structural member and a second structural member meet at a joint of a truss triangular unit. A bridge plate includes a central portion that spans across the joint. The bridge plate includes a first peripheral portion extending from the central portion in a direction of the first structural member and a second peripheral portion extending from the central portion in a direction of the second structural member. Each peripheral portion includes a slot and a first opening. A stirrup plate is provided for each peripheral portion. Each stirrup plate includes an interlocking mounting flange having an extending tab member received by the slot and a second opening aligned with the first opening. A mounting device extends through the aligned first and second openings to secure the stirrup plate and bridge plate to the underlying structural member.

24 Claims, 15 Drawing Sheets

(56) References Cited

U.S. PATENT DOCUMENTS

| | | | | |
|---|---|---|---|---|
| 6,047,513 | A * | 4/2000 | Gibson | 52/646 |
| 6,053,654 | A * | 4/2000 | Ledingham | 403/306 |
| 6,250,841 | B1 * | 6/2001 | Ledingham | 403/306 |
| 6,287,045 | B1 * | 9/2001 | Ledingham et al. | 403/306 |
| 6,523,309 | B1 * | 2/2003 | Finlay et al. | 52/169.5 |
| 7,891,144 | B2 * | 2/2011 | Gilstrap et al. | 52/92.2 |
| 8,459,604 | B2 * | 6/2013 | Smith et al. | 248/300 |
| 8,540,201 | B2 * | 9/2013 | Gadd et al. | 248/300 |
| 2010/0086348 | A1 * | 4/2010 | Funahashi et al. | 403/306 |
| 2011/0107710 | A1 * | 5/2011 | Sias | 52/655.1 |

* cited by examiner

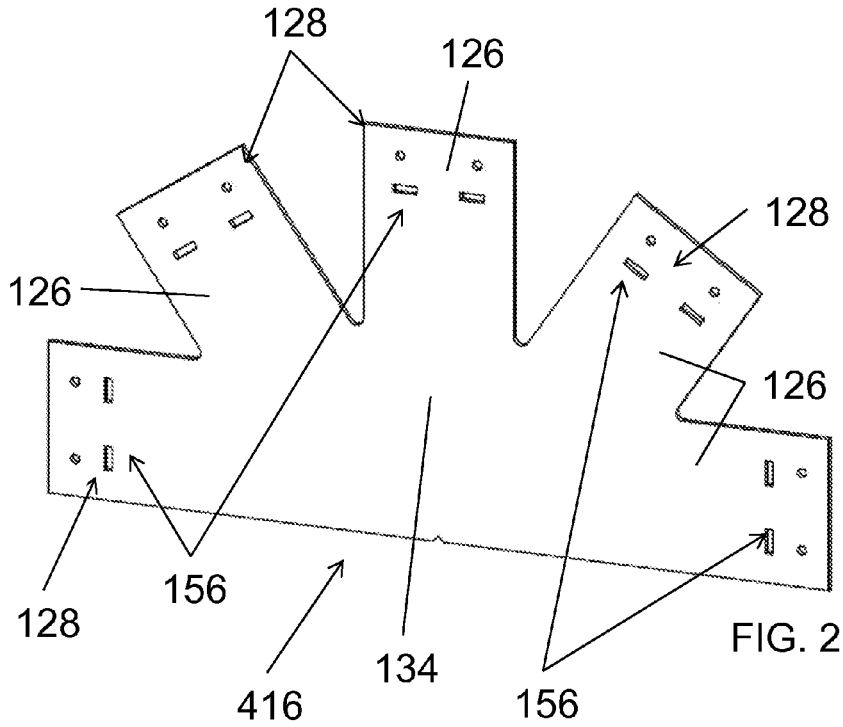
FIG. 20
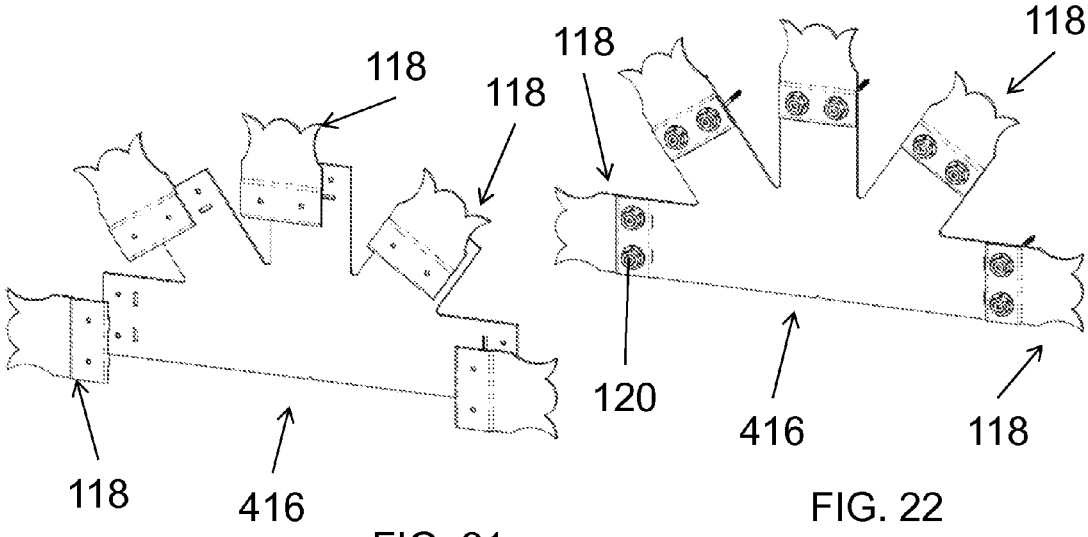
FIG. 21
FIG. 22

MULTI-PIECE TRUSS PLATE FOR USE IN JOINING TWO STRUCTURAL MEMBERS

PRIORITY CLAIM

This application claims priority from U.S. Provisional Application for Patent No. 61/669,180 filed Jul. 9, 2012, the disclosure of which is incorporated by reference.

BACKGROUND OF THE INVENTION

Technical Field of the Invention

The present invention relates generally to a truss plate for supporting a connection of two structural members and, in particular, to an ornamental truss plate having a multi-piece construction.

Description of Related Art

Many construction projects require the fabrication of a truss, for example a roof truss or a deck truss. A truss is a structure comprising one or more triangular units constructed from straight structural members connected together at joints commonly referred to as nodes or panel points. The most commonly recognized truss is a planar truss in which all the straight structural members and nodes (panel points) lie within a two dimensional plane. The connection between two structural members in a truss is typically supported by the application of a truss plate on one or both sides of the node (panel point). The truss plate bridges across the joint between the two structural members in the triangular unit, in the same plane as the planar truss lies, and is secured to both structural members. It is common for the joint between the two structural members to comprise some form of a butt joint, and thus truss plate serves to reinforce the butt joint.

FIG. 1 shows a common roof truss design including a plurality of structural members 10 arranged to form triangular units 12. The structural members 10 abut each other in the triangular units 12 at nodes 14 where joints 16 are formed. The joints 16 are reinforced by truss plates 18 attached to the sides of the structural members 10 to bridge across the joints 16. It will be noted that the truss plate 18 can have different styles depending on the configuration of the joint and the number of structural members meeting at the joint.

Truss plates are typically made of stamped galvanized steel and thus possess a utilitarian appearance driven by functional configuration. In most installations, the truss plates are hidden from view by the roofing and siding of the structure, and thus the galvanized utilitarian look of the truss plates is of no concern.

However, exposed trusses are of interest in many architectural designs, especially those designs mimicking old world craftsmanship. For example, exposed trusses are a common feature of Tudor constructions or constructions needing a vaulted or cathedral ceiling. It is also common to utilize exposed trusses in outdoor structures such as a pavilion. In these constructions, it is unacceptable for the galvanized truss plates and associated mounting hardware to be visible. It is thus typical for some form of finish carpentry to be used to conceal the truss plate from view. For example, the finish carpentry may box or case around the truss plate with wood trim pieces of a type similar to, or complementary of, the structural members.

What is needed is a truss plate that presents an aesthetically pleasing appearance suitable for use in an exposed truss construction without need for finish concealment.

There would further be an advantage if such a truss plate were configurable to support selection of ornamental features.

SUMMARY

In an embodiment, a multi-piece truss plate assembly comprises: a bridge plate having a central portion and a plurality of peripheral portions extending therefrom, where each peripheral portion includes at least one slot and at least one first opening; and a stirrup plate for each peripheral portion, each stirrup plate including an interlocking mounting flange having at least one extending tab member and at least one second opening, said second opening configured to align with said first opening when said at least one extending tab member engages said at least one slot.

In an embodiment, a multi-piece truss plate assembly comprises: a stirrup plate having a first flange and a second flange, the first flange offset in a plane of the stirrup plate from the second flange, the first flange including a central portion including at least one first opening and an edge from which at least one tab member extends in a direction substantially perpendicular to the plane of the stirrup plate; and a bridge plate configured to span across a truss joint, the bridge plate including a peripheral portion having at least one slot sized and shaped to receive the extending tab member and at least one second opening configured to be aligned with said at least one first opening when the tab member is received by the slot.

In an embodiment, an apparatus comprises: a first structural member having a first side surface; a second structural member having a second side surface; wherein the first and second structural members meet at a joint of a truss triangular unit; a bridge plate having a central portion bridging across the joint and further having a first peripheral portion extending from the central portion in a direction of the first structural member and a second peripheral portion extending from the central portion in a direction of the second structural member, where each peripheral portion includes at least one slot and at least one first opening; and a stirrup plate for each peripheral portion, each stirrup plate including an interlocking mounting flange having at least one extending tab member received by the at least one slot and at least one second opening configured to align with said first opening when said at least one extending tab member is received by said at least one slot.

BRIEF DESCRIPTION OF THE DRAWINGS

A more complete understanding of the method and apparatus of the present invention may be acquired by reference to the following Detailed Description when taken in conjunction with the accompanying Drawings wherein:

FIG. 20 is a perspective view of the bridge plate in the truss plate assembly of FIG. 19;

FIG. 21 shows an exploded perspective view of the relationship between the bridge plate and stirrup plates prior to interlocking;

FIG. 22 shows a perspective view of the interlocked relationship between the bridge plate and stirrup plates;

DETAILED DESCRIPTION OF THE DRAWINGS

Figure 2:
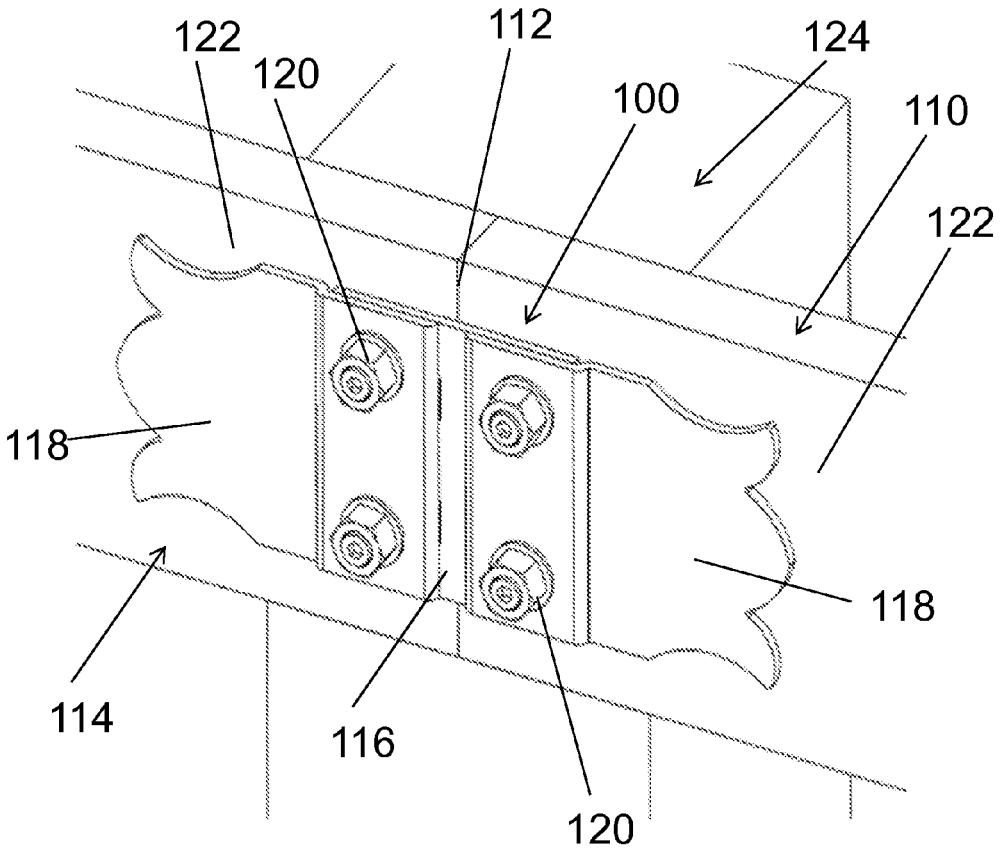
FIG. 2 is a perspective view of a multi-piece truss plate assembly.

Reference is now made to FIG. 2 which shows a perspective view of a multi-piece truss plate assembly 100 used for attaching a first structural member 110 to a second structural member 114. The first structural member 110 abuts the second structural member 114 at a joint 112. The assembly 100 includes a bridge plate 116 and a plurality of stirrup plates 118. The bridge plate 116 extends across the joint 112. Each stirrup plate 118 interlocks with the bridge plate 116 in a manner to be described in detail below. A mounting device 120, such as a screw or bolt, is used to attach the stirrup plate 118 and bridge plate 116 to the side surface 122 of the structural member 110 or 114.

The mounting device 120 may further be used to attach the structural member 110 or 114 to another structural member 124 (if present) on the opposite side of the surfaces 122. A construction of this type is shown in FIG. 2.

Figure 1:
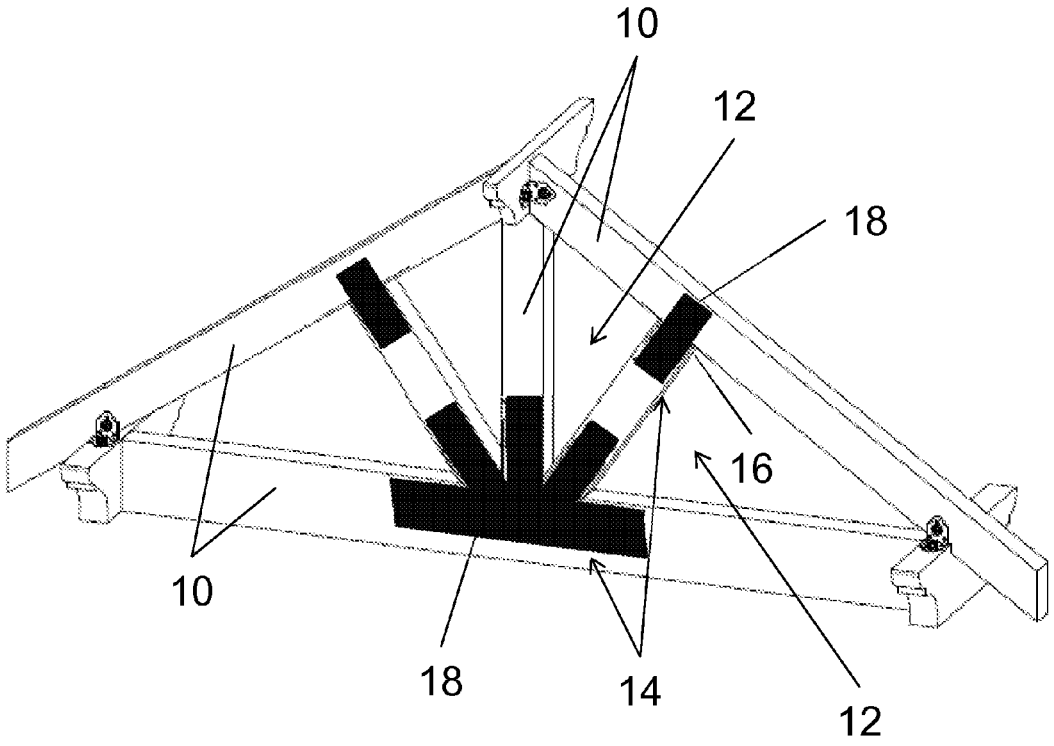
FIG. 1 (prior art)
FIG. 1 is a perspective view of a roof truss using prior art truss plates.

If the another structural member 124 is not present, however, an additional multi-piece truss plate assembly 100 may be used on the opposite side of structural members 110 and 114. In such a configuration, the mounting device 120 may pass through the structural member 110 or 114 so as to interconnect corresponding stirrup plates 118 on opposite sides of the structural members 110 and 114. This type of construction would be useful, for example in the truss assembly shown in FIG. 1.

The bridge plate 116 and stirrup plates 118 may be made from steel sheet cut in a desired pattern and shaped, for example by bending or stamping, into a desired shape. The steel may coated by painting or powder coating. The surface may be smooth or distressed. Alternatively, the bridge plate 116 and stirrup plates 118 may cast or otherwise molded.

Figure 3:
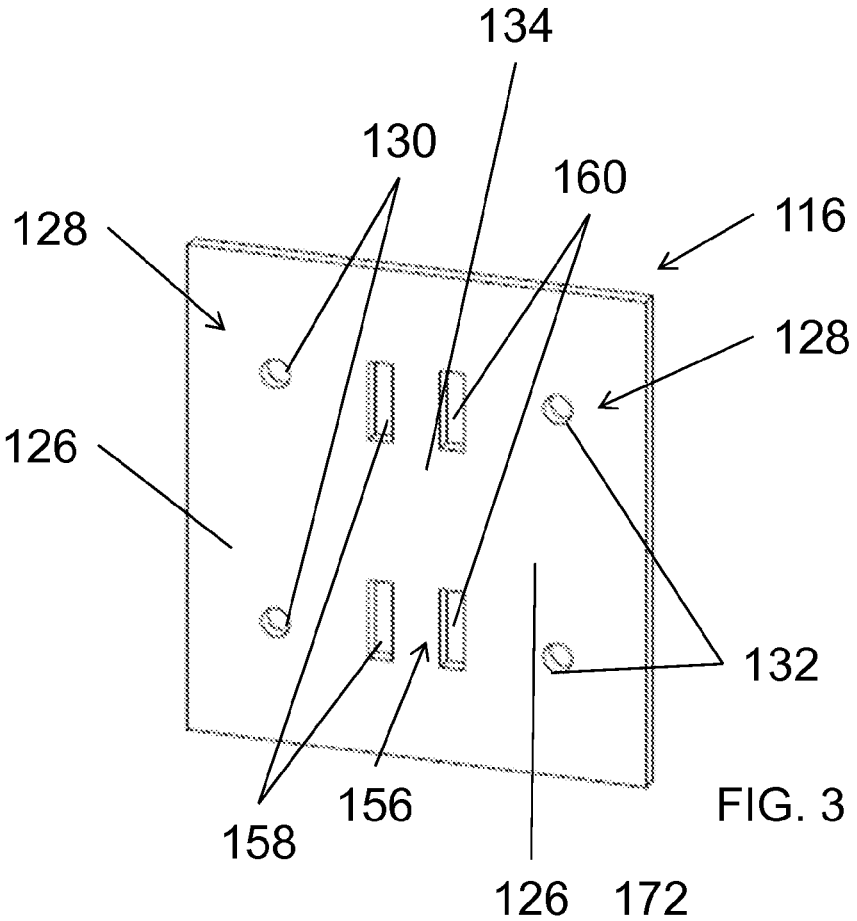
FIG. 3 is a perspective view of a bridge plate in the truss plate assembly of FIG. 2.

Reference is now made to FIG. 3 which shows a perspective view of the bridge plate 116 in the truss plate assembly 100 of FIG. 2. The bridge plate 116 has rectangular shape and is flat. A peripheral portion 126 at each end of the bridge plate 116 includes a plurality of mounting openings 128. The mounting openings 128 are configured to receive a mounting device 120 (such as a screw or bolt) for attaching an overlying stirrup plate 118 (not shown, see FIG. 2) and the bridge plate 116 to the side surface 122 of the structural member 110 or 114. The mounting openings 128 comprise a left pair of openings 130 at a first (left end of the bridge plate 116 (associated with a left overlying stirrup plate 118) and a right pair of openings 132 at a second (right) end of the bridge plate 116 (associated with a right overlying stirrup plate 118).

The peripheral portion 126 at each end of the bridge plate 116 further includes a plurality of slots (apertures) 156. The slots 156 are sized and shaped to receive corresponding tabs 138 (see, FIG. 4) on an overlying stirrup plate 118 (not shown, see FIG. 2). The slots 156 comprise a left pair of slots 158 near the first (left) end of the bridge plate 116 (associated with a left overlying stirrup plate 118) and a right pair of slots 160 near the second (right) end of the bridge plate 116 (associated with a right overlying stirrup plate 118).

A central portion 134 of the bridge plate 116 joins the peripheral portions 126 in a manner where the peripheral portions are aligned with each other and extend from the central portion 134 is opposite directions.

Figure 4A:
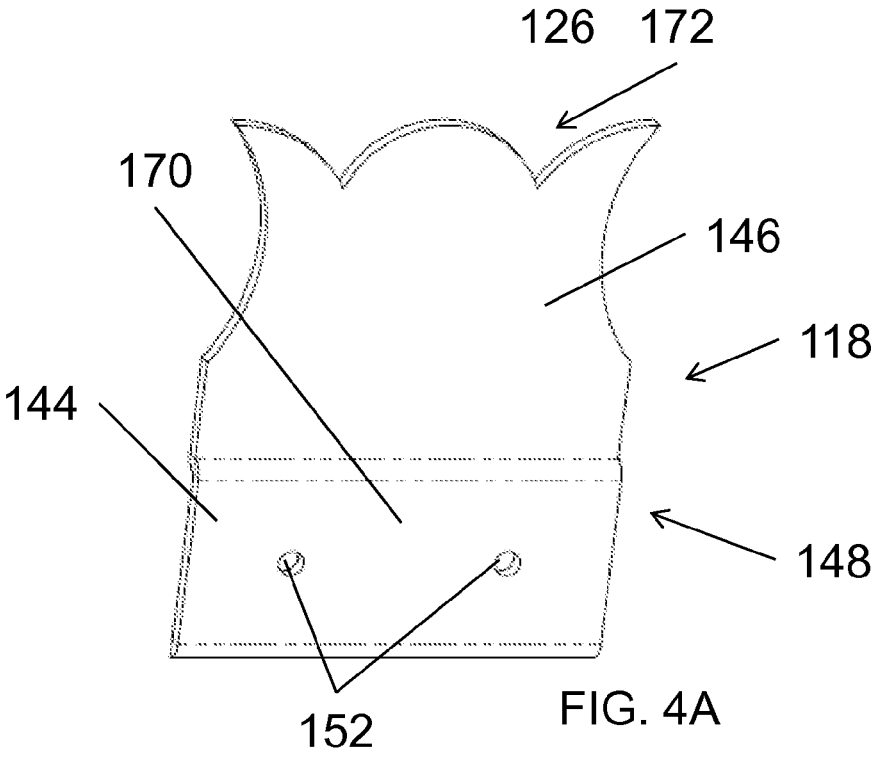
FIGS. 4A and 4B show front and back, respectively, perspective views of a stirrup plate in the truss plate assembly of FIG. 2.
Figure 4B:
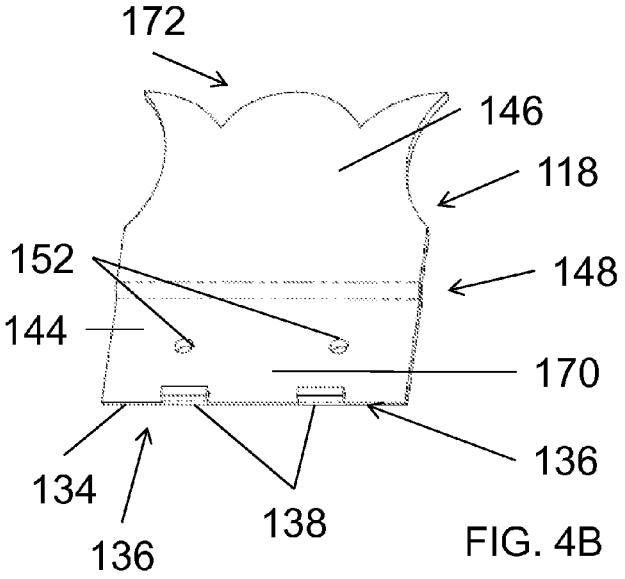
Figure 5:
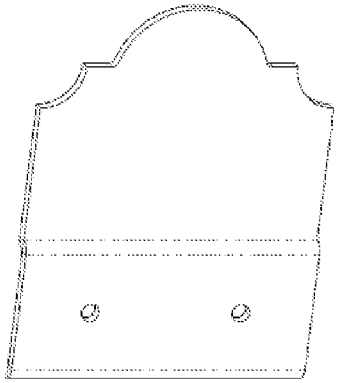
FIGS. 5-8 illustrate examples of ornamental feature designs for the stirrup plate.
Figure 6:
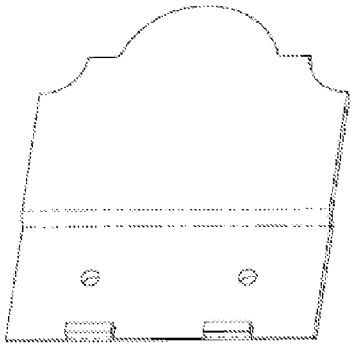
Figure 7:
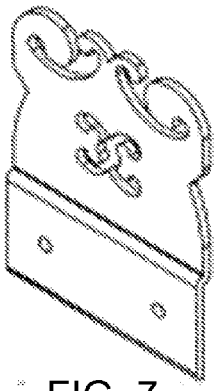
Figure 8:
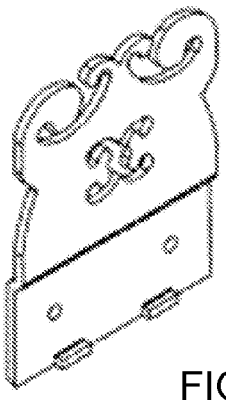

Reference is now made to FIGS. 4A and 4B which show front and back, respectively, perspective views of the stirrup plate 118 in the truss plate assembly 100 of FIG. 2. The stirrup plate 118 includes an interlocking mounting flange 144 and an ornamental flange 146. The stirrup plate 118 includes z-bend 148 that offsets the ornamental flange 146 from the interlocking mounting flange 144 by about the thickness of the bridge plate 116. Thus, the plane of the flange 144 is parallel to the plane of the flange 146.

A bottom edge 134 of the interlocking mounting flange 144 is bent and shaped to define a plurality of tabs (or projections) 138 extending generally perpendicularly from the back side surface of the interlocking mounting flange 144. For example, the edge 134 of the interlocking mounting flange 144 may include a plurality of cut-outs 136 which define the tabs 138. The tabs 138 are sized and shaped to engage the slots 156 provided in the central portion 134 of the bridge plate 116 (see, FIG. 3).

A central portion 170 of the interlocking mounting flange 144 includes a plurality of mounting openings 152. The mounting openings 152 are configured to receive a mounting device 120 (such as a screw or bolt) for attaching the stirrup plate 118 and an underlying bridge plate 116 (not shown, see FIG. 2) to the side surface 122 of the structural member 110 or 114. The mounting openings 152 are positioned to align with the openings 128 on the bridge plate 116 when the tabs 138 of the stirrup plate 118 engage the slots 156 of the bridge plate 116.

The ornamental flange 146 of the stirrup plate 118, and specifically a peripheral edge thereof, may include ornamental features 172. FIGS. 2 and 4A-4B show one example of an ornamental feature 172 design. See FIGS. 5-8 for other examples of ornamental feature designs. This difference in ornamental design, while retaining a common design and placement of the tabs 138 and mounting openings 152, is important because it allows for the stirrup plates 118 to be interchanged. Such an interchange may occur in connection with a renovation where the architectural and ornamental style of the construction changes. New stirrup plates 118, matching the new architectural and ornamental style, can be easily installed.

Figure 9:
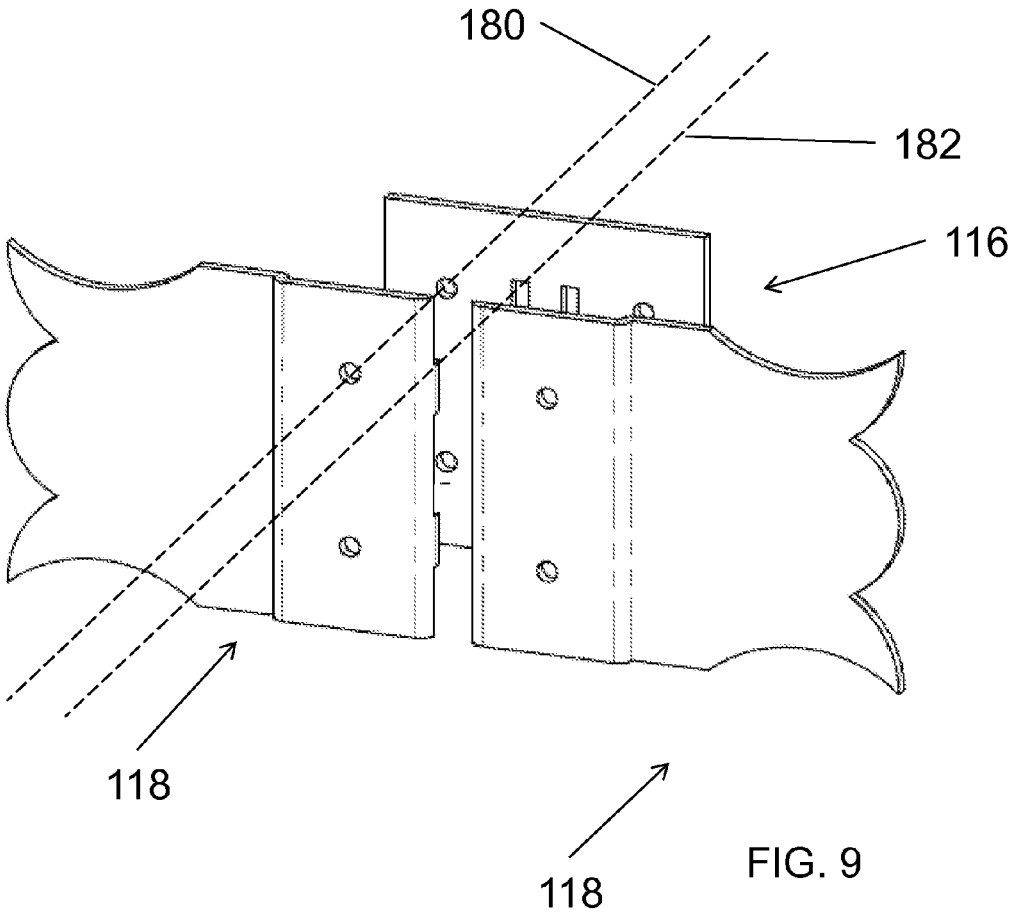
FIG. 9 shows an exploded perspective view of the relationship between the bridge plate and stirrup plates prior to interlocking.
Figure 10:
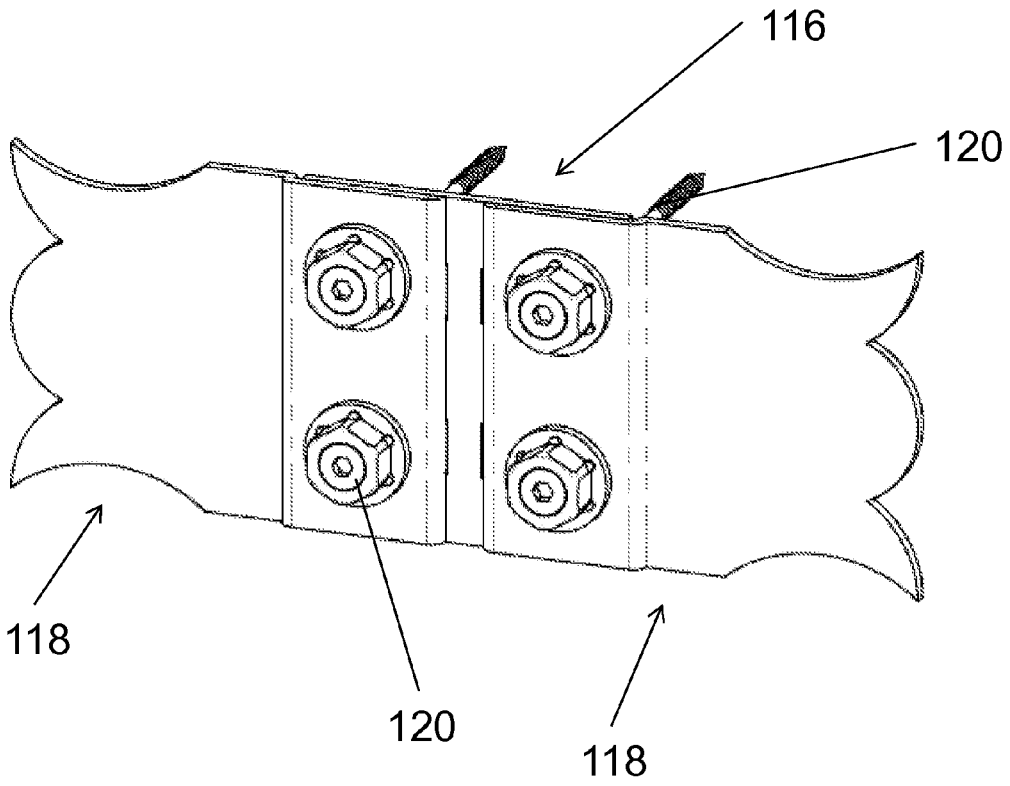
FIG. 10 shows a perspective view of the interlocked, relationship between the bridge plate and stirrup plates.

FIG. 9 shows an exploded perspective view of the relationship between the bridge plate 116 and stirrup plates 118 prior to interlocking. Reference 180 shows the alignment of the openings 152 and 128 for interlocking. Reference 182 shows the alignment of the tabs 138 and slots 156 for interlocking. FIG. 10 shows a perspective view of the interlocked relationship between the bridge plate 116 and stirrup plates 118. The tabs 138 are engaged with the slots 156. FIG. 10 further shows the use of mounting devices 120 passing through the aligned openings 152 and 128.

Figure 11:
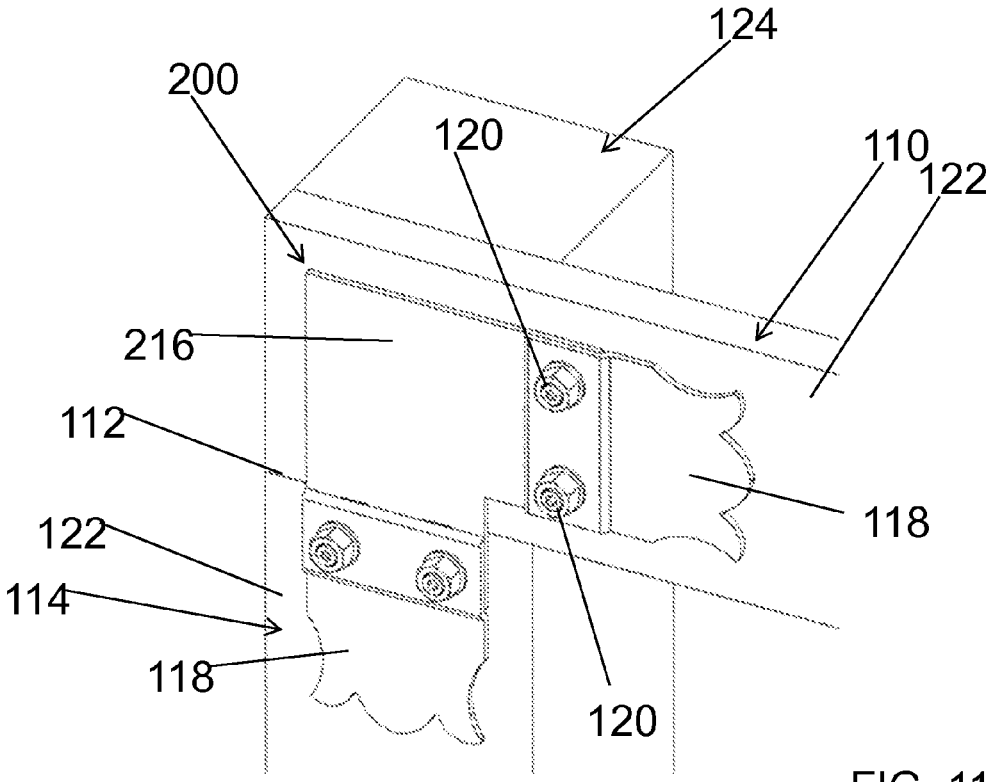
FIG. 11 is a perspective view of an alternative embodiment multi-piece truss plate assembly.

Reference is now made to FIG. 11 which shows a perspective view of an alternative embodiment for a multi-piece truss plate assembly 200 used for attaching a first structural member 110 to a second structural member 114. Like reference numbers refer to like or similar parts. The multi-piece truss plate assembly 200 of FIG. 11 differs from the assembly 100 of FIG. 2 in the type of bridge connection that is supported. The assembly 100 of FIG. 2 supports an end to end connection of structural members 110 and 114. While the assembly 200 of FIG. 11 supports an end to side L-connection of structural members 110 and 114.

Figure 12:
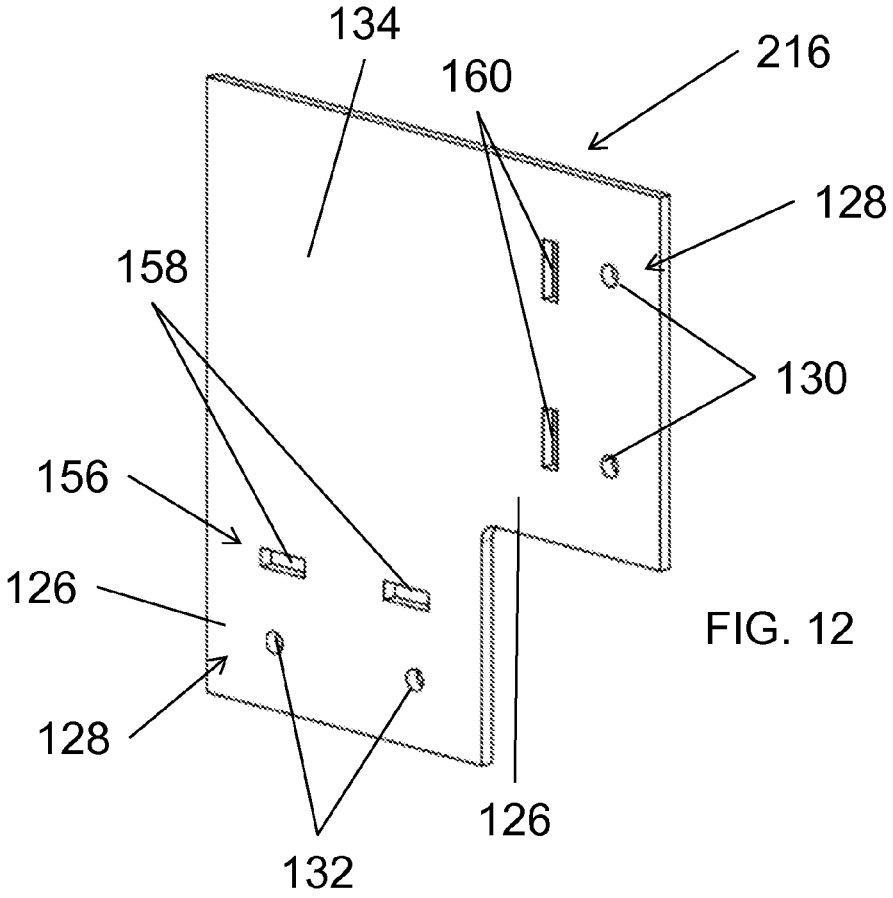
FIG. 12 is a perspective view of the bridge plate in the truss plate assembly of FIG. 11.

Reference is now made to FIG. 12 which shows a perspective view of the bridge plate 216 in the truss plate assembly 200 of FIG. 11. To support the end to side L-connection of structural members 110 and 114, the bridge plate 216 of the multi-piece truss plate assembly 200 of FIG. 11 is L-shaped and flat. The peripheral portions 126 are oriented perpendicular to each other extending from the central portion 134. Each peripheral portion 126 includes mounting openings 128 and slots (apertures) 156 as described above in connection with FIG. 3.

Figure 13:
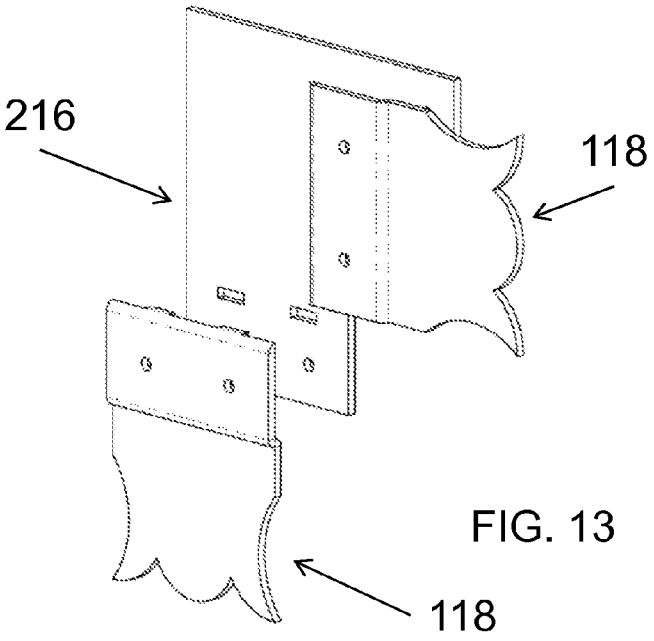
FIG. 13 shows an exploded perspective view of the relationship between the bridge plate and stirrup plates prior to interlocking.
Figure 14:
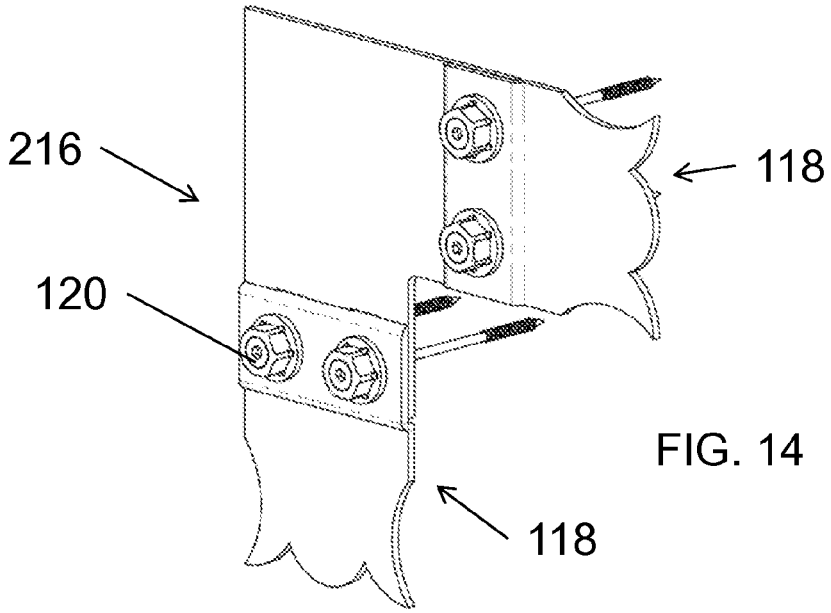
FIG. 14 shows a perspective view of the interlocked relationship between the bridge plate and stirrup plates.

FIG. 13 shows an exploded perspective view of the relationship between the bridge plate 216 and stirrup plates 118 prior to interlocking. FIG. 14 shows a perspective view of the interlocked relationship between the bridge plate 216 and stirrup plates 118. FIG. 14 further shows the use of mounting devices 120.

Figure 15:
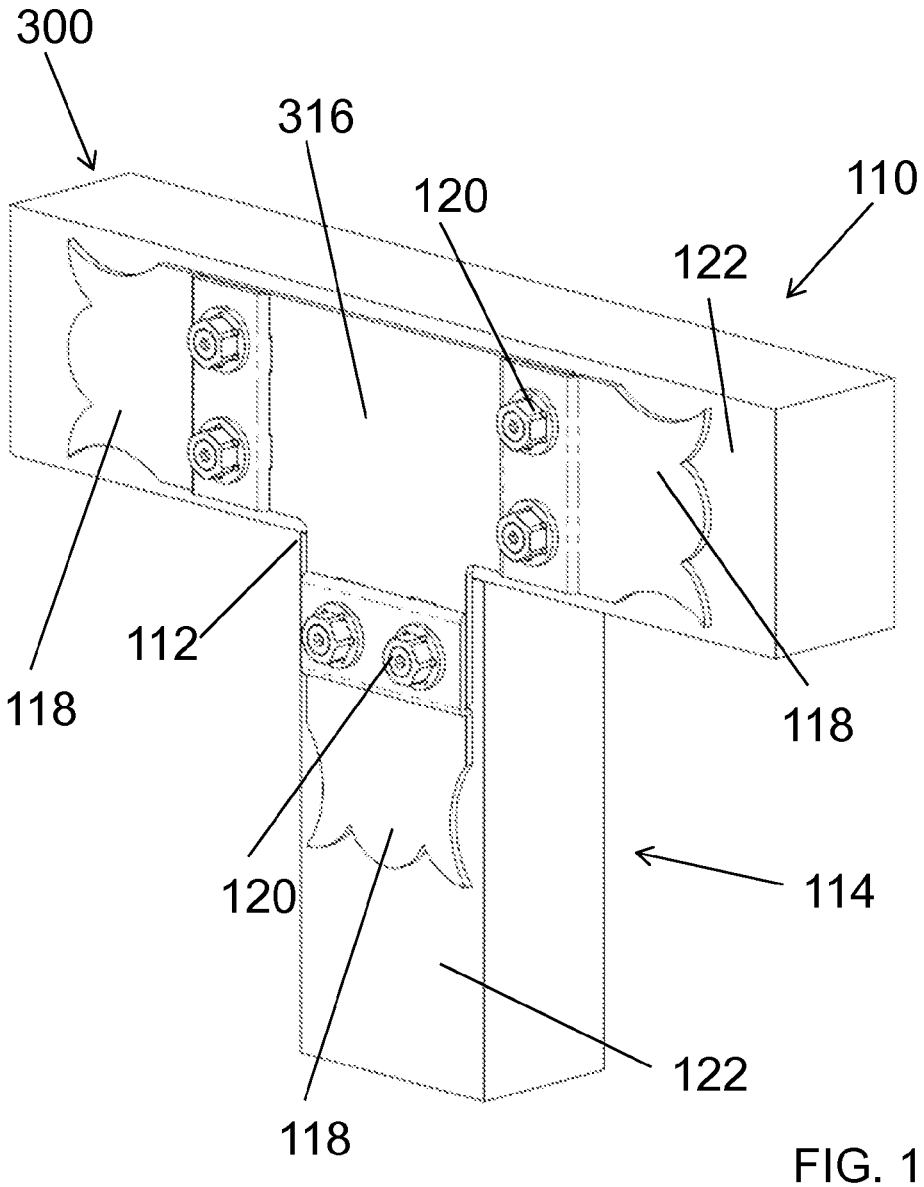
FIG. 15 is a perspective view of an alternative embodiment multi-piece truss plate assembly.

Reference is now made to FIG. 15 which shows a perspective view of an alternative embodiment for a multi-piece truss plate assembly 300 used for attaching a first structural member 110 to a second structural member 114. Like reference numbers refer to like or similar parts. The multi-piece truss plate assembly 300 of FIG. 15 differs from the assemblies 100 and 200 of FIGS. 2 and 11, respectively, in the type of bridge connection that is supported. The assembly 300 of FIG. 15 supports an end to side T-connection of structural members 110 and 114.

Figure 16:
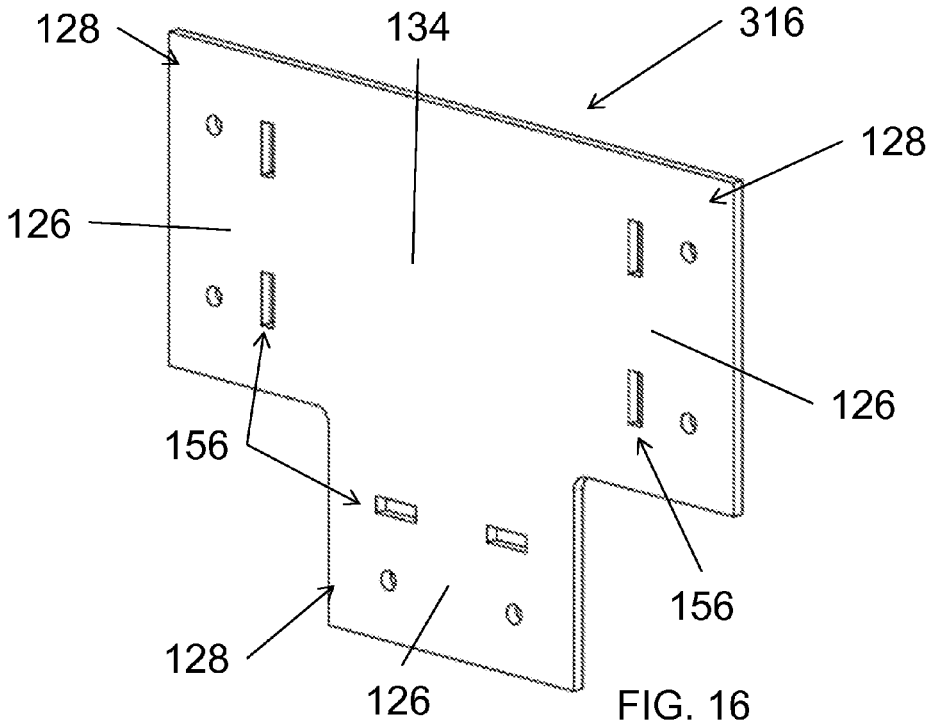
FIG. 16 is a perspective view of the bridge plate in the truss plate assembly of FIG. 15.

Reference is now made to FIG. 16 which shows a perspective view of the bridge plate 316 in the truss plate assembly 300 of FIG. 15. To support the end to side T-connection of structural members 110 and 114, the bridge plate 316 of the multi-piece truss plate assembly 200 of FIG. 11 is T-shaped and flat. The peripheral portions 126 are oriented such that two portions 126 are aligned with each other and extend in opposite directions from the central portion 134, and a third portion 126 is oriented perpendicular to the first two portions extending from the central portion 134. Each peripheral portion 126 includes mounting openings 128 and slots (apertures) 156 as described above in connection with FIG. 3.

Figure 17:
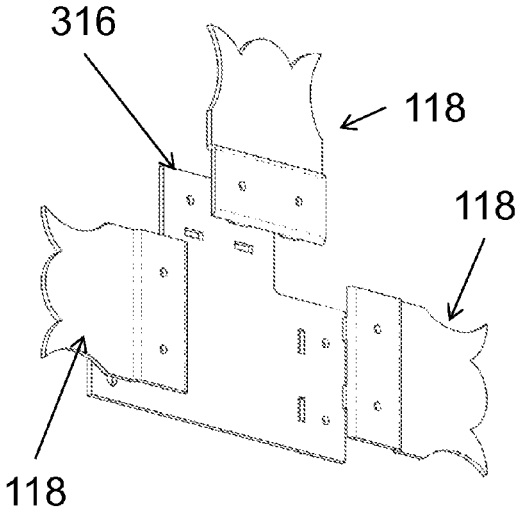
FIG. 17 shows an exploded perspective view of the relationship between the bridge plate and stirrup plates prior to interlocking.
Figure 18:
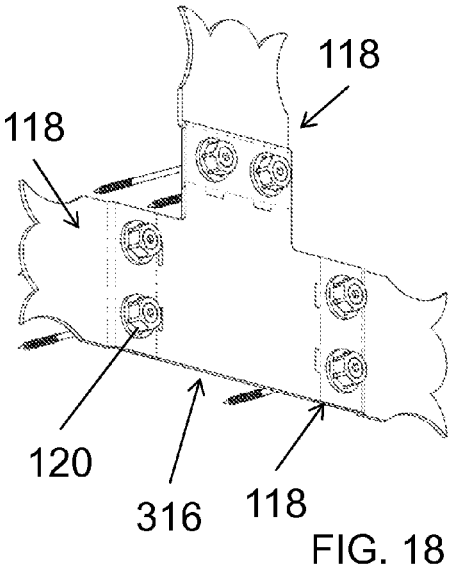
FIG. 18 shows a perspective view of the interlocked relationship between the bridge plate and stirrup plates.

FIG. 17 shows an exploded perspective view of the relationship between the bridge plate 316 and stirrup plates 118 prior to interlocking. FIG. 18 shows a perspective view of the interlocked relationship between the bridge plate 316 and stirrup plates 118. FIG. 18 further shows the use of mounting devices 120.

Figure 19:
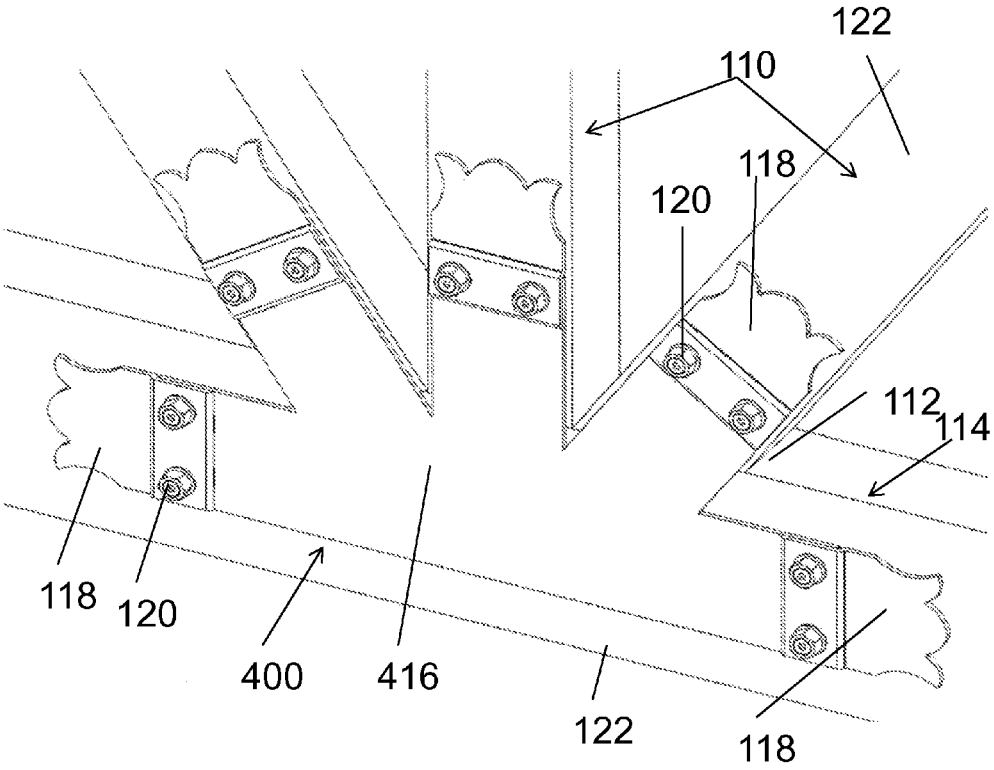
FIG. 19 is a perspective view of an alternative embodiment multi-piece truss plate assembly.

Reference is now made to FIG. 19 which shows a perspective view of an alternative embodiment for a multi-piece truss plate assembly 400 used for attaching a first structural member 110 to a second structural member 114. Like reference numbers refer to like or similar parts. The multi-piece truss plate assembly 400 of FIG. 19 differs from the assemblies 100, 200 and 300 of FIGS. 2, 11 and 15, respectively, in the type of bridge connection that is supported. The assembly 400 of FIG. 19 supports both end to end and end to side connections of structural members 110 and 114 with a fan configuration.

Reference is now made to FIG. 20 which shows a perspective view of the bridge plate 416 in the truss plate assembly 400 of FIG. 19. To support the connection of structural members 110 and 114 with the fan configuration, the bridge plate 316 of the multi-piece truss plate assembly 200 of FIG. 11 is fan-shaped and flat. The peripheral portions 126 are oriented such that two portions 126 are aligned with each other and extend in opposite directions from the central portion 134, a third portion 126 is oriented perpendicular to the first two portions extending from the central portion 134 and additional portions 126 are oriented to extend from the central portion at other angles. Each peripheral portion 126 includes mounting openings 128 and slots (apertures) 156 as described above in connection with FIG. 3.

FIG. 21 shows an exploded perspective view of the relationship between the bridge plate 416 and stirrup plates 118 prior to interlocking. FIG. 22 shows a perspective view of the interlocked relationship between the bridge plate 416 and stirrup plates 118. FIG. 22 further shows the use of mounting devices 120.

Figure 23:
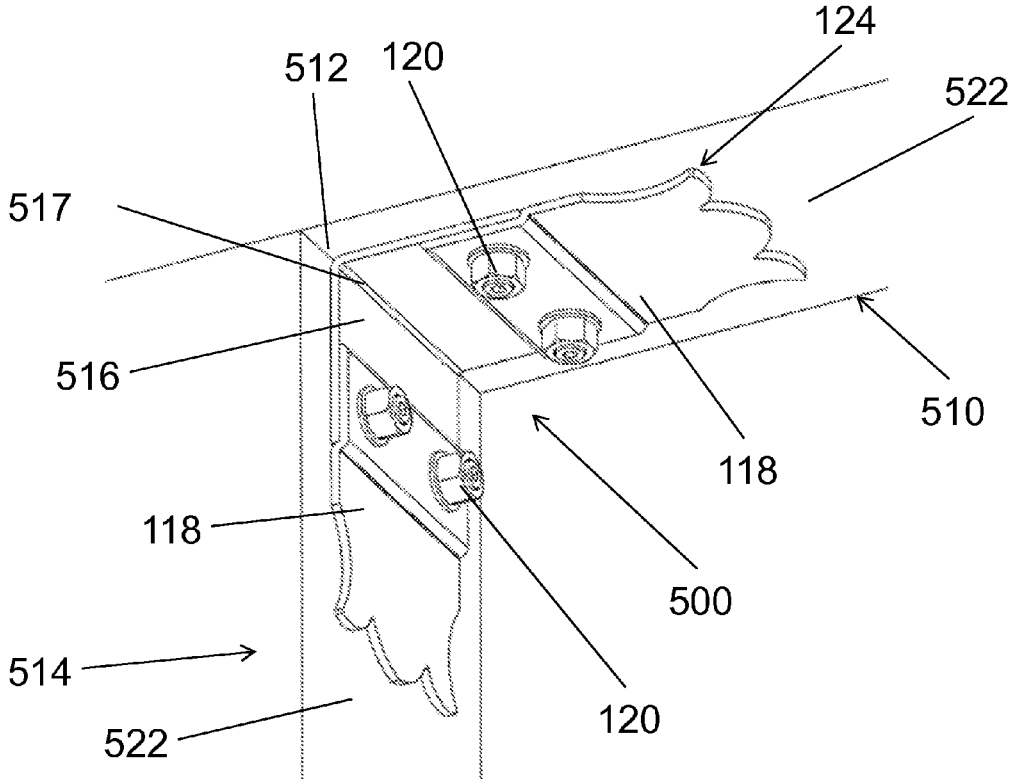
FIG. 23 is a perspective view of an alternative embodiment multi-piece truss plate assembly.

Reference is now made to FIG. 23 which shows a perspective view of a multi-piece truss plate assembly 500 used for attaching a first structural member 510 to a second structural member 514. The first structural member 510 abuts the second structural member 514 at a joint 512. The assembly 500 includes a bridge plate 516 and a plurality of stirrup plates 118. The bridge plate 516 extends across the joint 512. Each stirrup plate 118 interlocks with the bridge plate 416 in the manner described above. A mounting device 120, such as a screw or bolt, is used to attach the stirrup plate 118 to the side surface 522 of the structural member 510 or 514. It will be noted that the truss plate assembly 500 is used to make a different connection than that shown in FIG. 2. Specifically, the truss plate assembly 500 is used to make an inside corner connection between the first structural member 510 and the second structural member 514.

The bridge plate 516 may be made from steel sheet cut in a desired pattern and shaped, for example by bending or stamping, into a desired shape. The steel may coated by painting or powder coating. The surface may be smooth or distressed. Alternatively, the bridge plate 516 may cast or otherwise molded.

Figure 24:
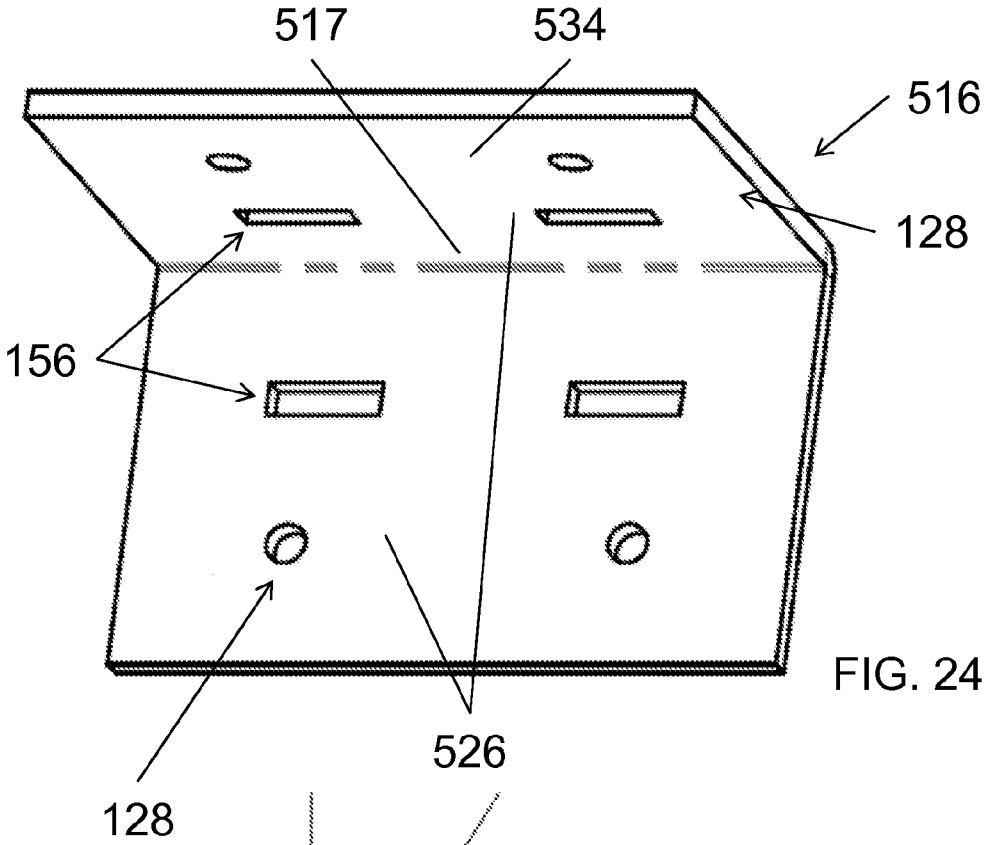
FIG. 24 is a perspective view of the bridge plate in the truss plate assembly of FIG. 23.
Figure 25:
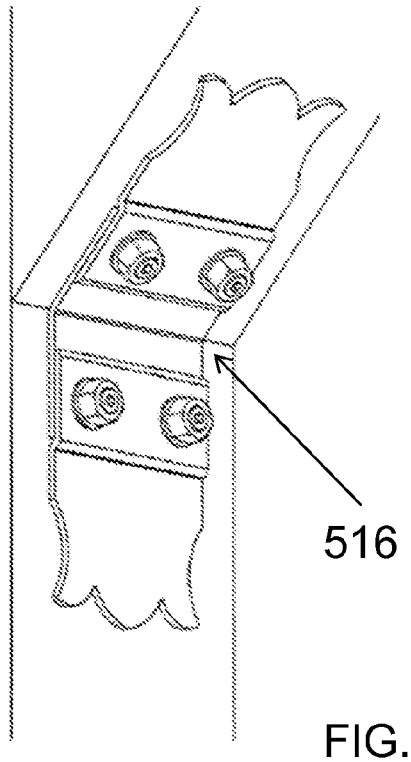
FIG. 25 is a perspective view of an alternative embodiment multi-piece truss plate assembly.
Figure 26:
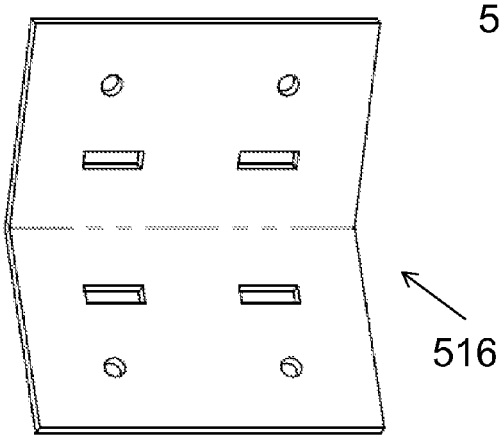
FIG. 26 is a perspective view of the bridge plate in the truss plate assembly of FIG. 25.

Reference is now made to FIG. 24 which shows a perspective view of the bridge plate 516 in the truss plate assembly 500 of FIG. 23. The bridge plate 516 has rectangular shape and is bent in the plane of the plate at bend 517 to a desired angle. FIG. 24 illustrates a bend to a ninety degree angle, although other angles, both acute and obtuse, could be selected depending on the application. For example, FIGS. 25 and 26 show an exemplary obtuse angle for the bridge plate 516. A peripheral portion 526 at each end of the bridge plate 516 includes a plurality of mounting openings 128. The mounting openings 128 are configured to receive a mounting device 120 (such as a screw or bolt) for attaching an overlying stirrup plate 118 (not shown, see FIG. 2) and the bridge plate 516 to the side surface 522 of the structural member 510 or 514. The peripheral portion 526 at each end of the bridge plate 516 further includes a plurality of slots (apertures) 156. The slots 156 are sized and shaped to receive corresponding tabs 138 on an overlying stirrup plate 118 (not shown, see FIG. 2). A central portion 534 of the bridge plate 516 includes the bend 517 and joins the peripheral portions 526 in a manner where the peripheral portions are aligned with each other and extend from the central portion 534 is opposite directions.

Figure 27:
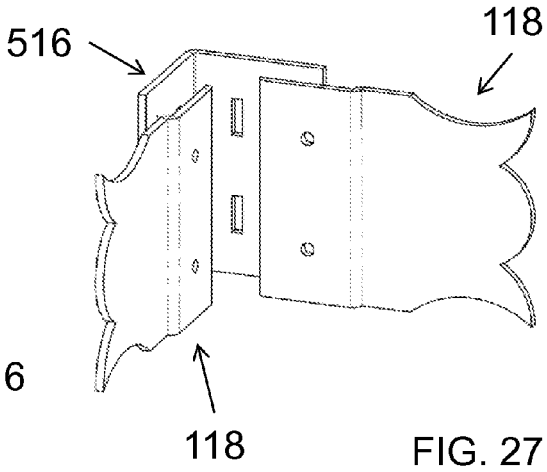
FIG. 27 shows an exploded perspective view of the relationship between the bridge plate and stirrup plates prior to interlocking.
Figure 28:
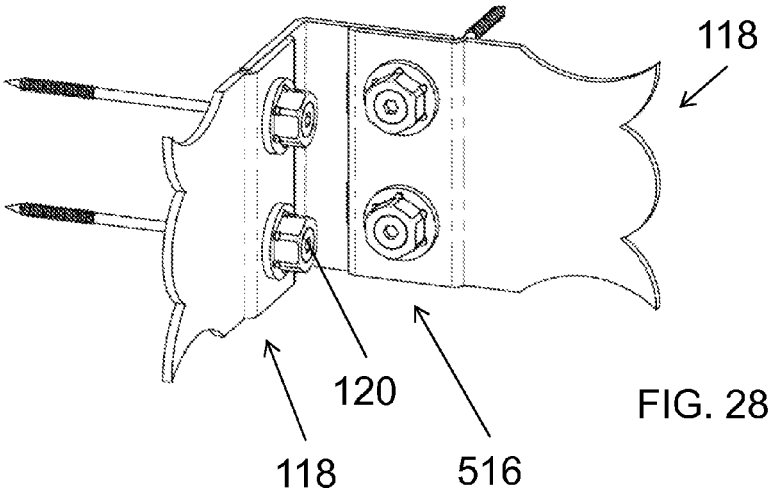
FIG. 28 shows a perspective view of the interlocked relationship between the bridge plate and stirrup plates.

FIG. 27 shows an exploded perspective view of the relationship between the bridge plate 516 and stirrup plates 118 prior to interlocking. FIG. 28 shows a perspective view of the interlocked relationship between the bridge plate 516 and stirrup plates 118 and further shows the use of mounting devices 120.

In assembling the multi-piece truss plate assembly 100, 200, 300, 400 or 500 the user selects the desired bridge plate 116, 216, 316, 416 or 516 (based on shape and configuration of the truss node) and selects the desired stirrup plate 118 (based for example on ornamental features). The bridge plate 116, 215, 316, 416 or 516 is positioned to bridge the joint 112, 512 of the truss where the structural members 110, 114, 510 and/or 514 meet. For each peripheral portion 126, 526 provided on the bridge plate 116, 216, 316, 416 or 516, a stirrup plate 118 is installed by aligning the openings 128 and 152 and inserting the tabs 138 into the slots 156. The mounting devices 120 are then inserted through the aligned openings and driven in to secure the stirrup plate 118 and bridge plate 116, 216, 316, 416 or 516 to the structural members 110, 114, 510 and/or 514.

As an alternative construction, a separate mounting device (such as a screw or bolt) may be used to attach the beam member 110 to the post member 114 prior to installation of the beam bracket 118. With this construction, the separate mounting device must be countersunk or recessed into the surface 122 of the beam member 110. The beam bracket 118 is then positioned on the side surface 122 of the beam member 110 with the interlocking flange 146 underneath the interlocking flange 126 and the tabs 138 formed by the cut-outs 136 in the edge 134 of the interlocking flange 126 inserted into the slots 156 formed at the bend where the mounting flange 144 meets the interlocking flange 146. Mounting devices 120 are then used to attach the beam bracket 118 to the beam member 110.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A multi-piece truss plate assembly, comprising:

a bridge plate having a central portion and a plurality of peripheral portions extending therefrom, where each peripheral portion includes at least one slot-shaped aperture being substantially rectangular and having a length and a width, wherein the length of each slot-shaped aperture is greater than the corresponding width and wherein each peripheral portion further includes at least one first opening, the length of each slot-shaped aperture extending perpendicular to a direction from the slot-shaped aperture toward the at least one first opening in each corresponding peripheral portion; and a stirrup plate for each peripheral portion, each stirrup plate including an interlocking mounting flange having at least one extending tab member and at least one second opening, said at least one second opening configured to align with said at least one first opening when said at least one extending tab member engages said at least one slot-shaped aperture;

wherein each stirrup plate further includes an ornamental flange planarly offset from the interlocking mounting flange at a z-bend by about a thickness of the bridge plate, and wherein the bridge plate is substantially planar.

2. The assembly of claim 1, wherein the plurality of peripheral portions include a first peripheral portion and a second peripheral portion.

3. The assembly of claim 2, wherein the first and second peripheral portions are aligned with each other and extend away from the central portion in opposite directions.

4. The assembly of claim 2, wherein the first and second peripheral portions extend away from the central portion in different directions.

5. The assembly of claim 4, wherein the different directions are perpendicular to each other.

6. The assembly of claim 4, wherein the different directions are not perpendicular to each other and not aligned opposite to each other.

7. The assembly of claim 2, wherein the plurality of peripheral portions further include a third peripheral portion.

8. The assembly of claim 7, wherein the first and second peripheral portions extend away from the central portion in aligned opposite directions and the third peripheral portion extends away from the central portion in a direction angled away from the first and second peripheral portions.

9. The assembly of claim 8, wherein the direction angled away is perpendicular to the first and second peripheral portions.

10. A multi-piece truss plate assembly, comprising:

a stirrup plate having a first flange and a second flange, the first flange being planarly offset from the second flange, the first flange including a central portion including at least one first opening and an edge from which at least one tab member extends in a direction substantially perpendicular to the plane of the stirrup plate; and a bridge plate configured to span across a truss joint, the bridge plate including a peripheral portion having at least one slot-shaped aperture sized and shaped to receive the at least one tab member and at least one second opening configured to be aligned with said at least one first opening when the at least one tab member is received by the slot-shaped aperture, wherein the slot-shaped aperture is spaced apart from the at least one first opening.

11. The assembly of claim 10, wherein the second flange includes an ornamental edge.

12. The assembly of claim 10, wherein the first flange is planarly offset from the second flange at a z-bend by about a thickness of the bridge plate.

13. The assembly of claim 10, wherein bridge plate includes a plurality of peripheral portions extending in different directions away from a central portion of the bridge plate.

14. The assembly of claim 13, wherein the different directions are aligned opposite directions.

15. The assembly of claim 13, wherein the different directions are perpendicular directions.

16. The assembly of claim 13, wherein the bridge plate central portion includes a bend in a plane of the bridge plate.

17. Apparatus, comprising:

a first structural member having a first side surface;

a second structural member having a second side surface;

wherein the first and second structural members meet at a joint;

a bridge plate having a central portion bridging across the joint and further having a first peripheral portion extending from the central portion in a direction of the first structural member and a second peripheral portion extending from the central portion in a direction of the second structural member, where each peripheral portion includes at least one slot-shaped aperture and at least one first opening, wherein each slot-shaped aperture is substantially rectangular and includes a length and a width, wherein the length of each slot-shaped aperture is greater than the corresponding width and each length extends perpendicularly to the corresponding peripheral portion; and a stirrup plate for each peripheral portion, each stirrup plate including an interlocking mounting flange having at least one extending tab member received by the at least one slot-shaped aperture and at least one second opening configured to align with said at least one first opening when said at least one extending tab member is received by said at least one slot-shaped aperture.

18. The apparatus of claim 17, wherein the first and second side surfaces define an inside corner joint of a truss triangular unit.

19. The apparatus of claim 17, wherein the first and second side surfaces are in a same plane at the joint.

20. The apparatus of claim 17, further including a mounting device passing through the aligned first and second openings to secure the bridge plate and stirrup plate to one of the first and second side surfaces of a corresponding one of the first and second structural members.

21. The apparatus of claim 17, wherein each stirrup plate further includes an ornamental flange offset from a plane of the interlocking mounting flange at a z-bend by about a thickness of the bridge plate.

22. A multi-piece truss plate assembly, comprising:

a bridge plate having a central portion configured to bridge across a joint formed by abutment of a first structural member extending in a first direction and a second structural member extending in a second direction, the bridge plate further having a first peripheral portion extending from the central portion in the first direction and a second peripheral portion extending from the central portion in the second direction, where each peripheral portion includes a slot-shaped aperture and a first opening; and a plurality of stirrup plates, each stirrup plate configured to couple to a respective peripheral portion, each stirrup plate including an interlocking mounting flange having an extending tab member received by the slot-shaped aperture and a second opening configured to align with the first opening when the extending tab member is received by the slot-shaped aperture;

wherein each stirrup plate includes an ornamental flange extending from and being planarly offset from each interlocking mounting flange at a z-bend by a thickness of the bridge plate.

23. The assembly of claim 22 wherein a rear face of each interlocking mounting flange contacts a front face of the respective peripheral portions when the stirrup plates are coupled to the respective peripheral portions of the bridge plate.

24. The assembly of claim 23 wherein a rear face of the ornamental flange of each stirrup plate is configured to contact the second structural member when the stirrup plates are coupled to the respective peripheral portions of the bridge plate.

* * * * *